US006029409A

United States Patent [19]

Wilson

[11] Patent Number: 6,029,409

[45] Date of Patent: Feb. 29, 2000

[54] DOOR AND DOORWAY SHIELD

[76] Inventor: Roger D. Wilson, 10409 Stardust Dr., Boise, Id. 83709

[21] Appl. No.: 09/161,339

[22] Filed: Sep. 25, 1998

[51] Int. Cl.[7] ..... B65D 65/02

[52] U.S. Cl. ..... 52/202; 52/3; 52/103; 52/DIG. 12; 49/383; 150/154

[58] Field of Search ..... 52/3, 23, 202, 52/203, DIG. 12; 49/383; 150/154, 901

[56] References Cited

U.S. PATENT DOCUMENTS

| | | | |
|---|---|---|---|
| 4,372,364 | 2/1983 | Katz . | |
| 4,888,918 | 12/1989 | Green et al. | 52/784.12 X |
| 5,103,593 | 4/1992 | McNaughton . | |
| 5,255,727 | 10/1993 | Saruwatari et al. . | |
| 5,351,733 | 10/1994 | Ullman . | |
| 5,443,885 | 8/1995 | Wilson . | |
| 5,488,804 | 2/1996 | Batscher . | |
| 5,537,779 | 7/1996 | Jackson | 49/62 |
| 5,603,194 | 2/1997 | Fridlyand et al. | 52/515 |
| 5,649,390 | 7/1997 | Davidson | 52/3 |
| 5,737,878 | 4/1998 | Raulerson et al. . | |
| 5,799,443 | 9/1998 | Koeniguer . | |
| 5,800,006 | 9/1998 | Pettigrew | 296/136 |
| 5,918,430 | 7/1999 | Rowland | 52/202 |

*Primary Examiner*—Bett Aubrey
*Assistant Examiner*—Brian E. Glessner
*Attorney, Agent, or Firm*—Ken J. Pedersen; Barbara S. Pedersen

[57] ABSTRACT

Embodiments of a door and doorway shield system are shown and described, each including at least one hook for hanging or gripping onto a portion of the door or the doorway. The shield preferably hangs on the door by a J-shaped hook portion that extends substantially along the entire top edge of the shield. The shield includes a protective portion which extends across the space between a door and a doorway and across the trim molding of the doorway to substantially cover, or hook on, the front trim molding of the doorway. In embodiments which hook on the trim molding, the trim hook holds the shield in place to provide resistance to impacts pushing the shield off of the door. A J-shaped hook portion may also be provided on the bottom of the shield, to allow for connection to the bottom of the door or for turning the shield up-side-down for use both left-hinged and right-hinged doors.

14 Claims, 8 Drawing Sheets

DOOR AND DOORWAY SHIELD

BACKGROUND OF THE INVENTION

1. Field of the Invention

This invention relates to protective devices for building surfaces for use during construction, remodeling, and moving of appliances and furniture in or out of the building. More specifically, this invention relates to a shield for protecting a door and its nearby doorway trim.

2. Related Art

There is a need for protection of interior and exterior doors after the doors have been hung and are vulnerable to damage during the final phases of construction, fixture installation, and the process of moving residents into the building. These phases typically involve the movement of large and bulky objects and equipment through the doorway, and the door and doorway opening is often gouged or scraped by the objects/equipment or the tools/handcarts or those moving the items. Therefore, great expense could be spared if the doors and their associated doorway trim could be temporarily covered and cushioned until the construction and moving-in process is complete.

Katz (U.S. Pat. No. 4,372,364, issued Feb. 8, 1983) discloses a protector which extends down the front of a door and is adjustable in length. The Katz protector has a top pocket that receives the top end of a door, and a bottom flap which can be folded up and fastened to adjust the length of the protector.

McNaughton (U.S. Pat. No. 5,103,593, issued Apr. 14, 1992) discloses a door shield with pleated surface for offering impact resistence. The McNaughton device includes magnetic and adhesive members for adherence to the door.

Saruwatari et al. (U.S. Pat. No. 5,255,727, issued Oct. 26, 1993) discloses a multi-piece door cover assembly which protects the sides and edges of a door and is attached to the door so that the door may be used, closed and locked. Saruwatari et al. uses a plurality of flaps that curve from one side of the door, around between the hinges to attach to the other side of the door. Saruwatari et al. also includes a cut-out for the door handle to allow use and locking of the door while the cover is installed.

Ullman (U.S. Pat. No. 5,351,733, issued Oct. 4, 1994) discloses a protector having a combination of pockets, straps, and extensions for covering a door. The protector is attached to the top end of the door by a pocket on the outer door corner and by a loop strap on the inner door corner. Buckling straps extends in several places around the door and an extension is Velcro®-attached to the lower portion of the protector for adjustment of the overall length of the protector.

Koeniguer (U.S. Pat. No. 5,799,443, Sep. 1, 1998) discloses a door and door fame protector, which includes a hinge side frame cover and a latch side frame cover. The hinge side frame cover includes a front frame cover panel which extends along the front of the door frame and to the door to cover part of the door, and an L-shaped member extends into the gap between the door and the door frame for frictionally securing the cover to the door. Additionally, a door-clip on a tensioning cord extends from the cover to the edge of the door. The front frame cover panel along the front of the door frame does not engage or connect to the door frame, but merely extends adjacent to the door frame.

Still, there is a need for a simple and economical shield system, which is easy and quick to use. There is a need for shield system that protects both a door and its adjacent doorway surfaces.

SUMMARY OF THE INVENTION

The present invention comprises a shield system for protecting a door and its adjacent doorway surfaces from damage by traffic of people, construction materials and tools, equipment, dollies, furniture, boxes and other items through the doorway. The present invention is convenient system that takes little time to install and, hence, will be used more readily by construction workers and furniture movers.

The invented shield system protects both the door surface and the surfaces of the doorway on the side wherein the hinges are attached. The invention comprises a shield which has a door portion that preferably extends substantially across at least one side of a door, and a trim portion adapted to extend through the doorway and substantially across the vertical doorway trim molding. The preferred shield extends substantially all the way from top end to bottom end of the door and from the hinge edge of the door to the latch edge of the door. Alternatively, the shield may extend part of the way toward the latch edge to protect the part of the door normally damaged by impact. Use of the invented shield system, therefore, may prevent damage to the door surface, but also to the very vulnerable doorjamb and trim molding materials which are typically gouged and scratched as often as is the door itself.

One or more hook portions or other connection means may be included for holding the shield in place to provide a good fit and to optimize protection of the door and doorway. Preferably, the hooks include a hook on the top of the shield to extending over the top end of the door. The hooks may include a hook on the outer end of the trim portion for catching or gripping on the edge of the trim. The hooks may include a bottom hook for extending around the bottom end of the door and/or for allowing the shield to be reversed for either right or left opening doors.

The preferred shield system is adaptable to many sizes of doors and doorways, and preferably may be used on either right or left-opening doors by turning the shield up-side-down. The shield is preferably hung on the door with one or more hook portions or a combination or hook portion and optional cord which may extend lengthwise around or along the door. Such flexibility of installation adds to the convenience and universality of the invented system.

The preferred material for the shield is a material that is tough and puncture-resistant, but that is flexible enough to curve and bend for easy installation. A two-layer composition, comprising a tough layer of polymer, and a cushioning layer of foam, is the preferred material of construction. Preferably, the hooked portions are bent and crimped integral portions of the two-layer material, which results in a resilient hook member, or the hook portions may be made by bending scored panels near the shield's edges, which results in a less resilient but still well-fitting hook for extending around edges of the door.

DESCRIPTION OF THE PREFERRED EMBODIMENTS

Referring to the Figures, there are shown several, but not the only, embodiments of the invented door and doorway shield. The Figures illustrate some of the preferred combinations of connections means for holding the invented shield on a door and doorway.

Figure 1:
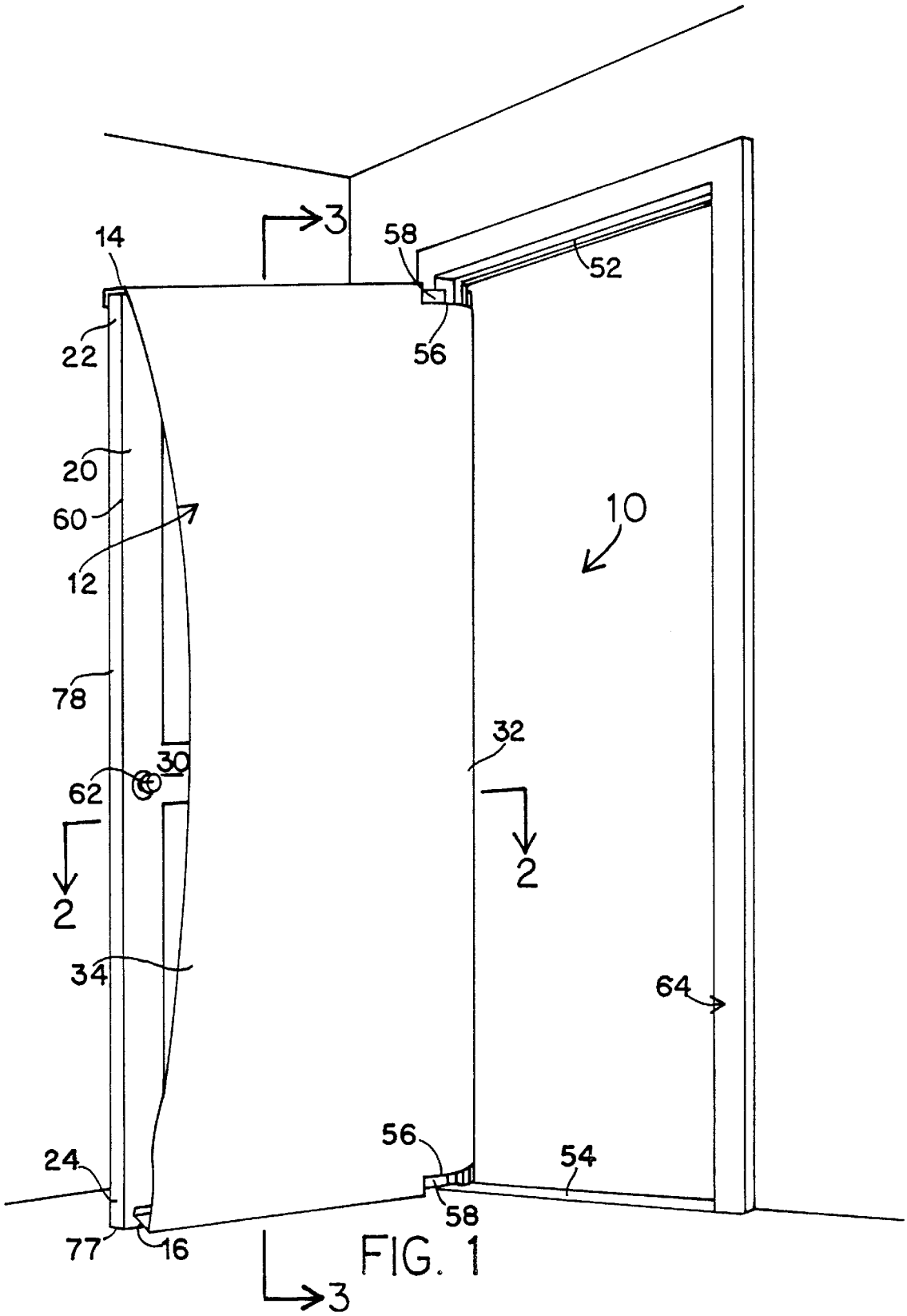
FIG. 1 is a perspective view of one embodiment of the invention installed on a door and doorway.
Figure 2:
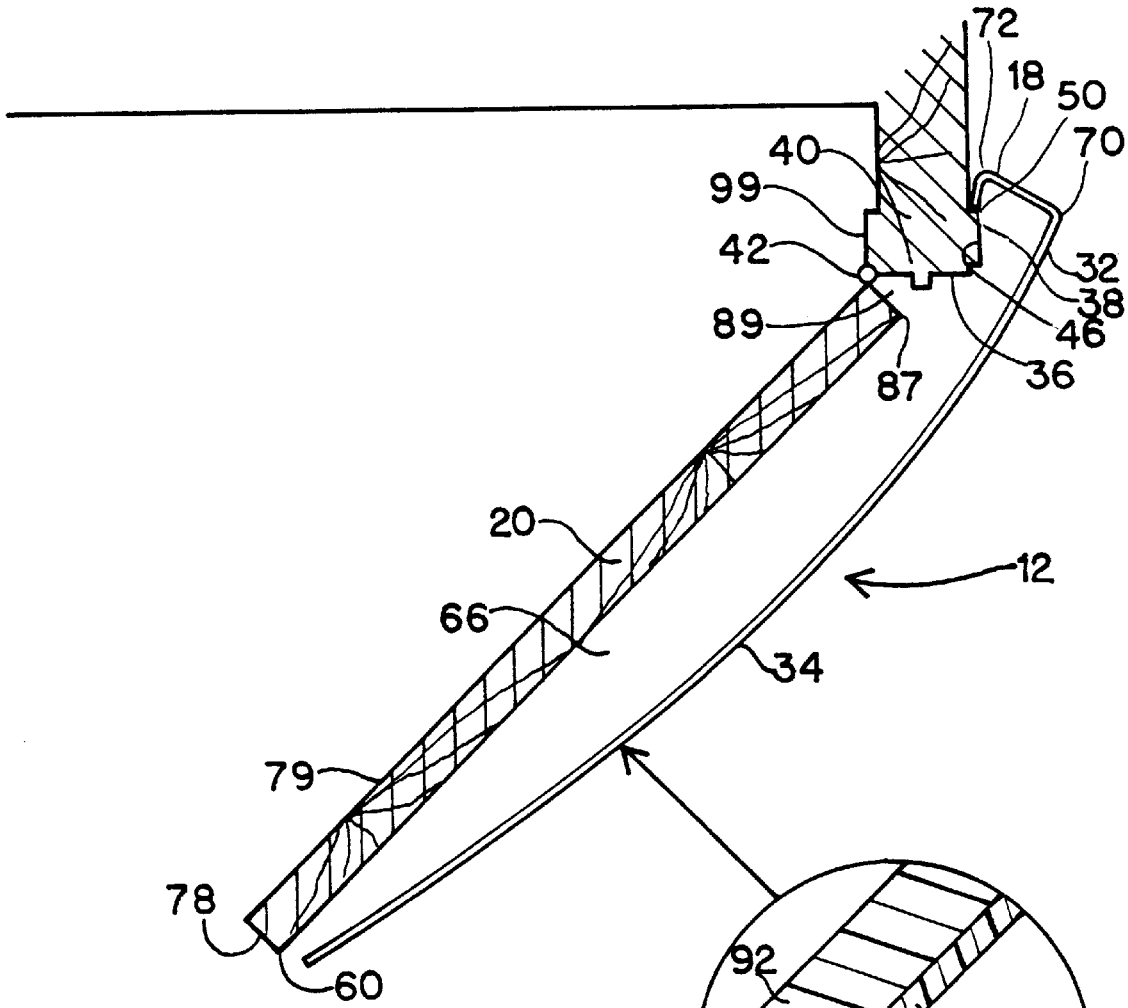
FIG. 2 is a top cross-sectional view of the embodiment of FIG. 1, viewed along the line 2—2 in FIG. 1, and with a detail showing preferred materials of construction of the shield.
Figure 2A:
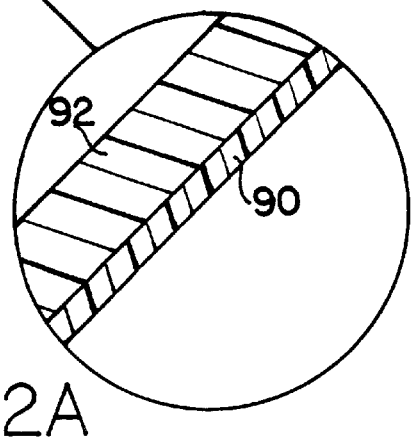
Figures 3, 3A:
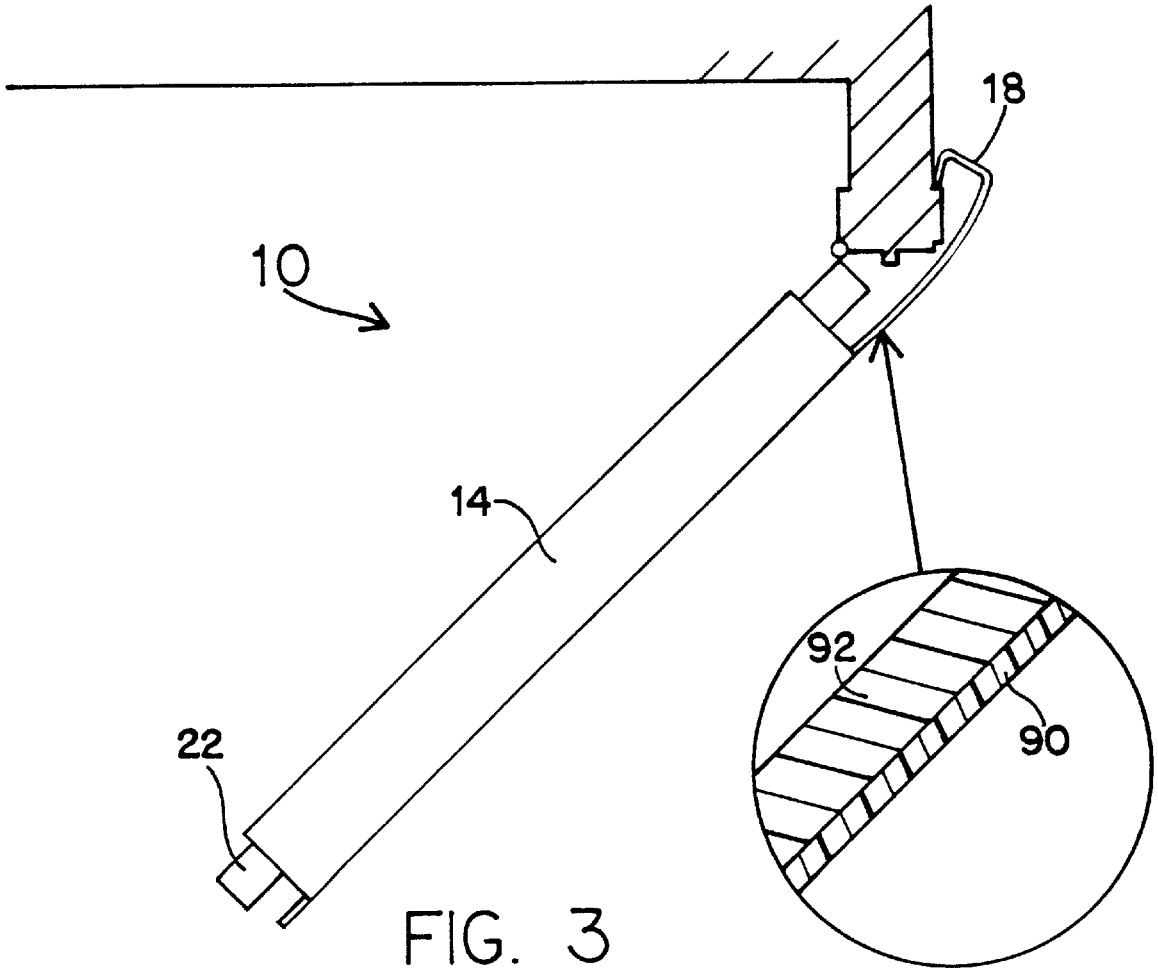
FIG. 3 is a top view of the embodiment of FIG. 1.
Figure 4:
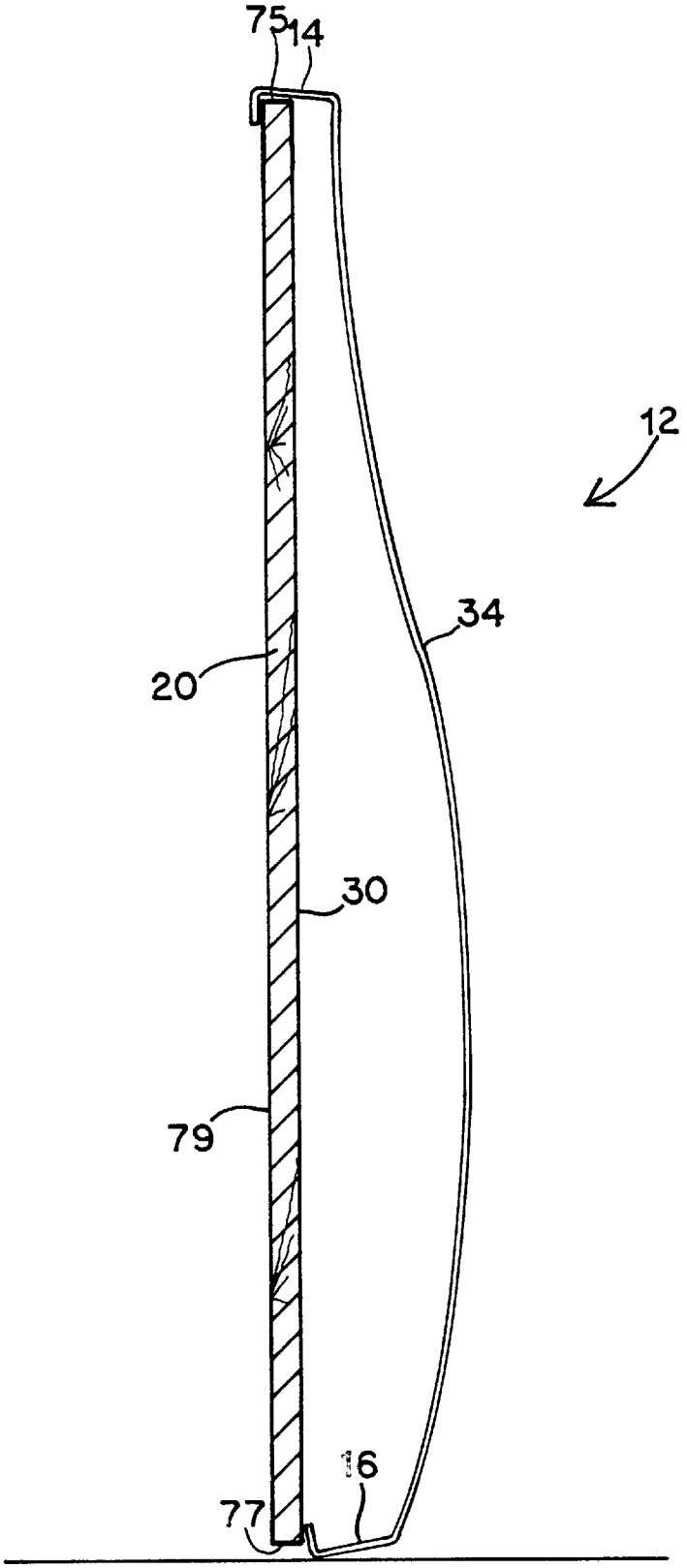
FIG. 4 is a side cross-sectional view of the embodiment of FIG. 1, viewed along the line 3—3 in FIG. 1.

FIGS. 1, 2 and 3 illustrate an embodiment of the shield system 10 having a shield 12 with top hook portion 14 and bottom hook portion 16 (also referred to herein as "top and bottom hooks") and with a trim hook portion 18 (trim hook). The shield 12 hangs on the door 20 by means of the top hook 14 extending over the top end 22 of the door, and is further secured by the trim hook 18. The bottom hook 16 is shown in FIGS. 1 and 4 as hanging loose from the door 20, that is, not extending around the bottom end 24 of the door. Alternatively, the bottom hook 16 may be installed around the bottom end 24 of the door, if the shield 12 is sized appropriately for that hook 16 to fit, and if the user finds it convenient. Especially for instances where the shield 12 is somewhat shorter than the total length of the door 20, the bottom hook 16 may hang loose beside the door front surface 30, while still protecting a substantial amount of the door front surface.

The shield provides an extension referred to herein as the trim portion 32, which extends preferably integrally from the main shield portion 34 of the shield 12 for reaching out and around the doorjamb system 36 and the door trim molding 38, which are installed in the doorway 40 near the hinge 42 area. The trim portion 32 preferably extends across the gap 44 between the door 20 and the doorway 40 and at least to the middle 46 of the trim molding. This way the door 20 and molding 38 are protected from most impacts, which typically are against the edge of the molding or against the inner area of the door. Preferably, the trim portion 32 extends all the way to the edge surface 50 of the molding, which is generally at about 90 degrees to the front surface of the trim molding and about 90 degrees to the wall in which the doorway is situated. The trim portion 32 preferably includes a trim hook 18 which bends around to hook on the edge surface 50 of the molding. The combination of a trim hook 18 with a top hook 14 provides good securement of the shield on the door 20, without requiring magnets, adhesive, straps, or other fastening means. Preferably, the material of the shield is rigid and resilient enough that the hooks serve to "hang" the shield on/around the door, without the cumbersome fastening means of other door protector designs.

The trim portion 32 preferably has a lesser height dimension than the shield portion 34 of the shield. In other words, the shield 12 is notched at both bottom and top near the trim portion to give room for the trim portion to fit between the top doorjamb 52 and the threshold 54 These notches 56 are extended inward enough to allow the shield to fit a variety of door sizes and doorway widths. In some applications, therefore, a small corner area 58 of the door will be exposed (as in FIG. 1), but this typically poses little chance of damage, because few impacts would be on these areas.

The preferred symmetrical shape of the shield allows it to be turned up-side-down for use on a mirror image door, that is, both right and left opening doors. In the design of FIG. 1, the shield may be turned up-side-down and the bottom hook of FIG. 1 would then become the top hook, and the top hook of FIG. 1 would hang near the door bottom or hook around the door bottom.

The preferred shield 12 extends all of the way to the outer door edge 60, or preferably nearly to the outer door edge 60. Preferably, the shield covers the door knob 62 or handle, and does not include any holes in the shield for the knob/handle. This way, the main shield portion 34 provides a tough, continuous protective surface all the way from the trim's edge surface 50, across the gap 44 and the door 20, to the door latch edge or "outer edge" 60. This way, objects that impact anywhere along that continuum tend to slide along the shield 12 without harming any part of the doorway 40, door 20, or door knob assembly 62. This way, objects do not get wedged in the gap 44. Users tend to become aware of a tight or impossible fit of the object through the doorway before the possibility of damage, and the user can then maneuver and adjust the object to get it through the doorway without damaging the building. The shield 12 is particularly effective when used in combination with a pad or protector installed on the jamb and molding system 64 across the doorway from the invented shield.

The shield 12 need not fit tightly or closely against the door front surface 30, but preferably extends substantially along the entire height and width of the door 20 on at least one side of the door. As shown in the drawings, there may be a significant gap 66 between the shield and the door as it spans across the door. The shield need not be attached/connected to the door between the doorway and the outer edge 60. There preferably is no member of the shield assembly for extending between the door and the door frame, that is, no member need extend into the hinge area or contact the door on its hinge surface or its rear surface near the hinges. The shield system need not have any member that extends to contact the back trim molding 99. With the door in the open position, the shield 12 hangs/grips on enough points on the door to be secure during use, and then is quickly and easily removed after use.

Therefore, the preferred shield is made with one or more edges that include or are bent into a hook member, that preferably extends substantially along its entire edge of the shield. Preferably, the top edge of the shield portion is bent into a hook member, and, optionally, the trim portion may be bent into a hook member or may be bent to shield but not necessarily hook onto the trim (see FIG. 5). Optionally, and less preferably, the outer door edge area of the shield may also be bent into a hook member.

The shield material may be crimped during manufacture to create the hooks, for example, by a heating, crimping, and cooling technique that may form a generally resilient and permanent hook shape. The preferred hook is generally J-shaped, that is, it has two generally right angles 70, 72, so that it extends generally coplanar with the shield portion 34, bends about 90 degrees for 2–3 inches, and then bends about 90 degrees again to form a short tab for extending along another surface for hanging (top hook) or gripping (trim hook). Thus, top and bottom hook portions 14, 16 extend from the door front surface 30, along the door top surface 75 or bottom surface 77, respectively, and then along preferably a short distance of the door back surface 79. The hook angles may be other than 90 degrees, and having the hooks be acute angles may provide a tighter-gripping hook on the top end 22 of the door, for example. Thus, the hooks preferably are not smoothly curved, but angled to fit well over or under the door top/bottom ends.

Figures 6, 6A:
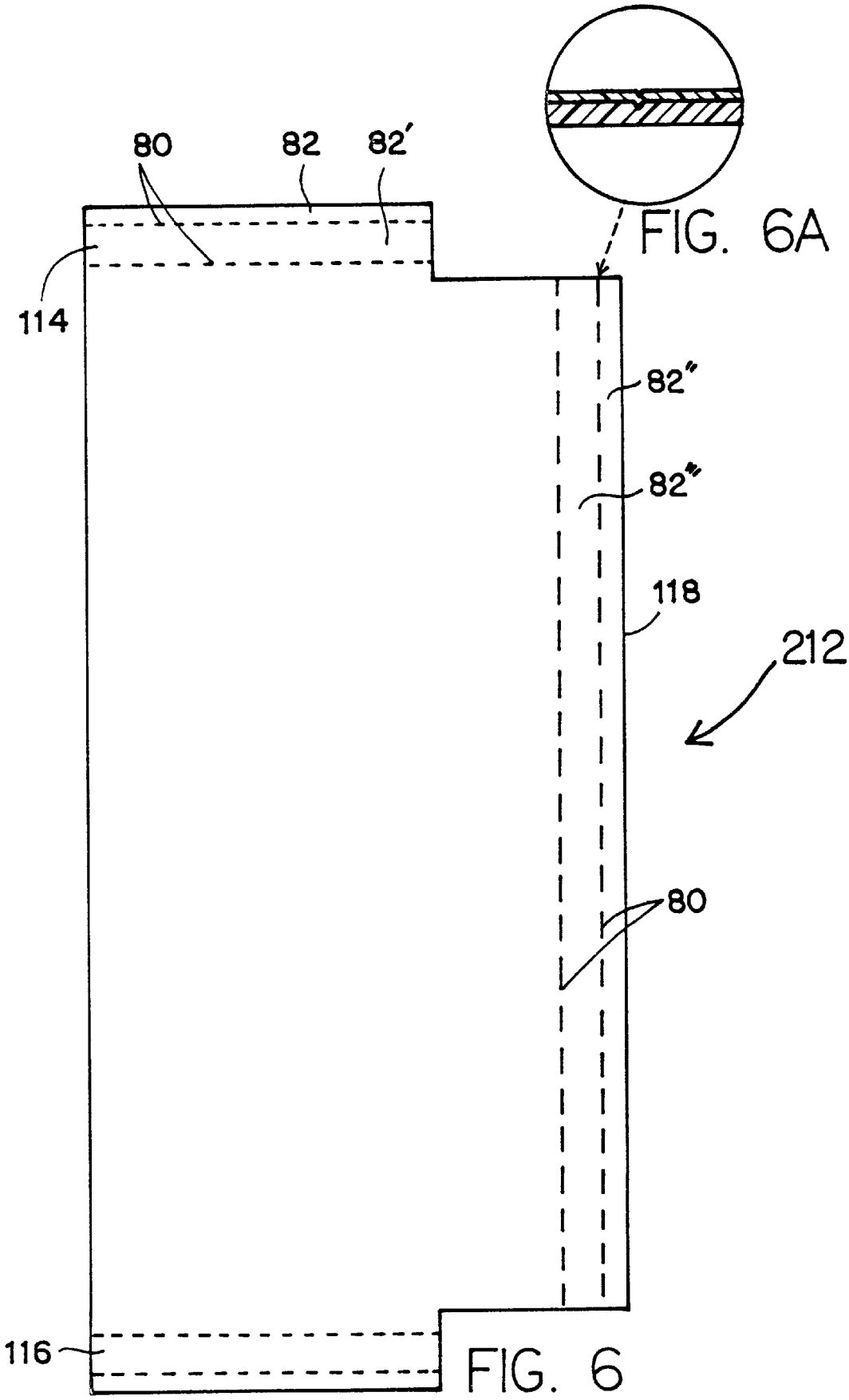
FIG. 6 is a front view of another embodiment of the invented shield, flattened-out and with score lines for forming top, bottom, and trim hook portions and with a detail showing materials of construction.
Figure 7:
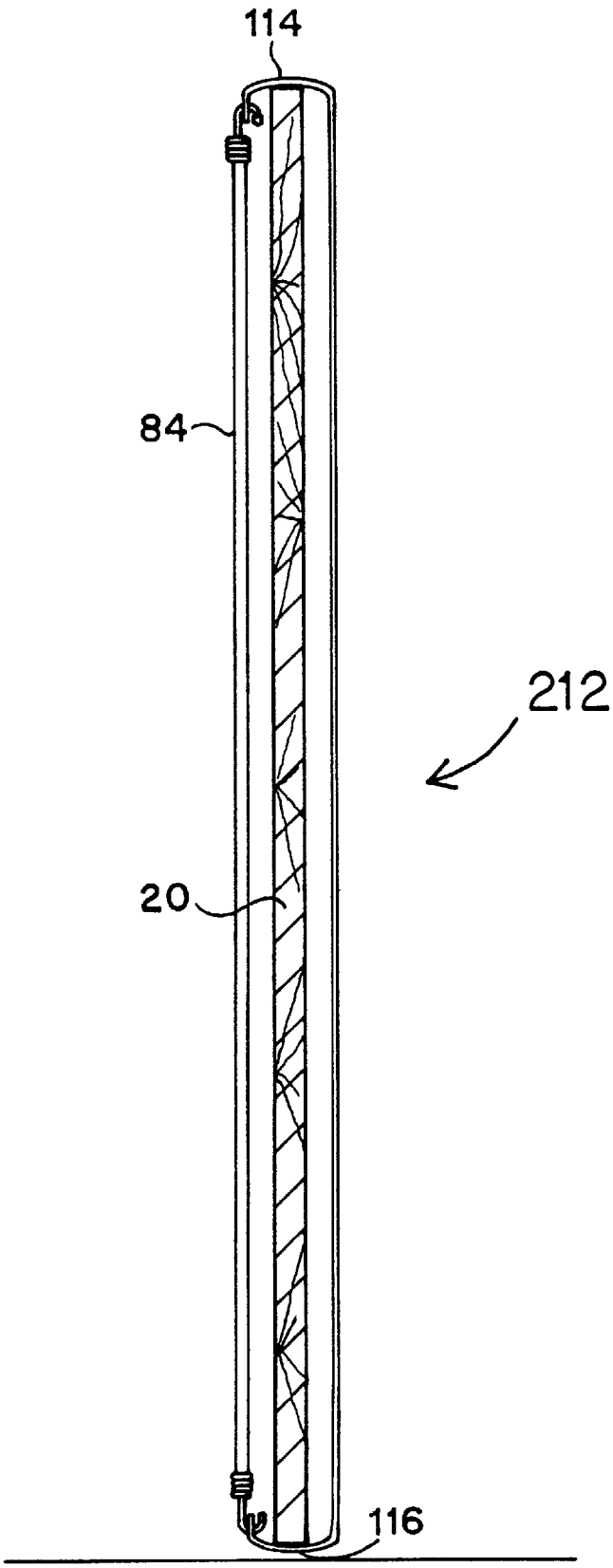
FIG. 7 is a side cross-sectional view of an alternative method of connecting an embodiment of the invented shield to a door.

Alternatively, the hooks may be shaped otherwise or made by other methods. For example, the shield system of FIGS. 6 and 7 illustrates an alternative approach which is conveniently adapted to various sizes of doors and doorways, and which may be more easily rolled for transport and storage. In this embodiment, a flat shield 212 (FIG. 6) includes score lines 80 which delineate several panels 82, 82', 82", 82''' which may be folded on site to form hook portions for the top, bottom, and trim hooks 114, 116, 118. Because the hooks thus-formed tend to have less permanency and less resilience than those bent and crimped during manufacture by the heating and cooling method, the user will often find that additional securement is necessary. FIG. 7 shows a bungee-style cord 84 connecting the top hook and bottom hook portions 114, 116 of the embodiment of FIG. 6. The shield of FIG. 6 may have pre-formed apertures (not shown) near its edges for receiving a cord or other tying member.

Figure 5:
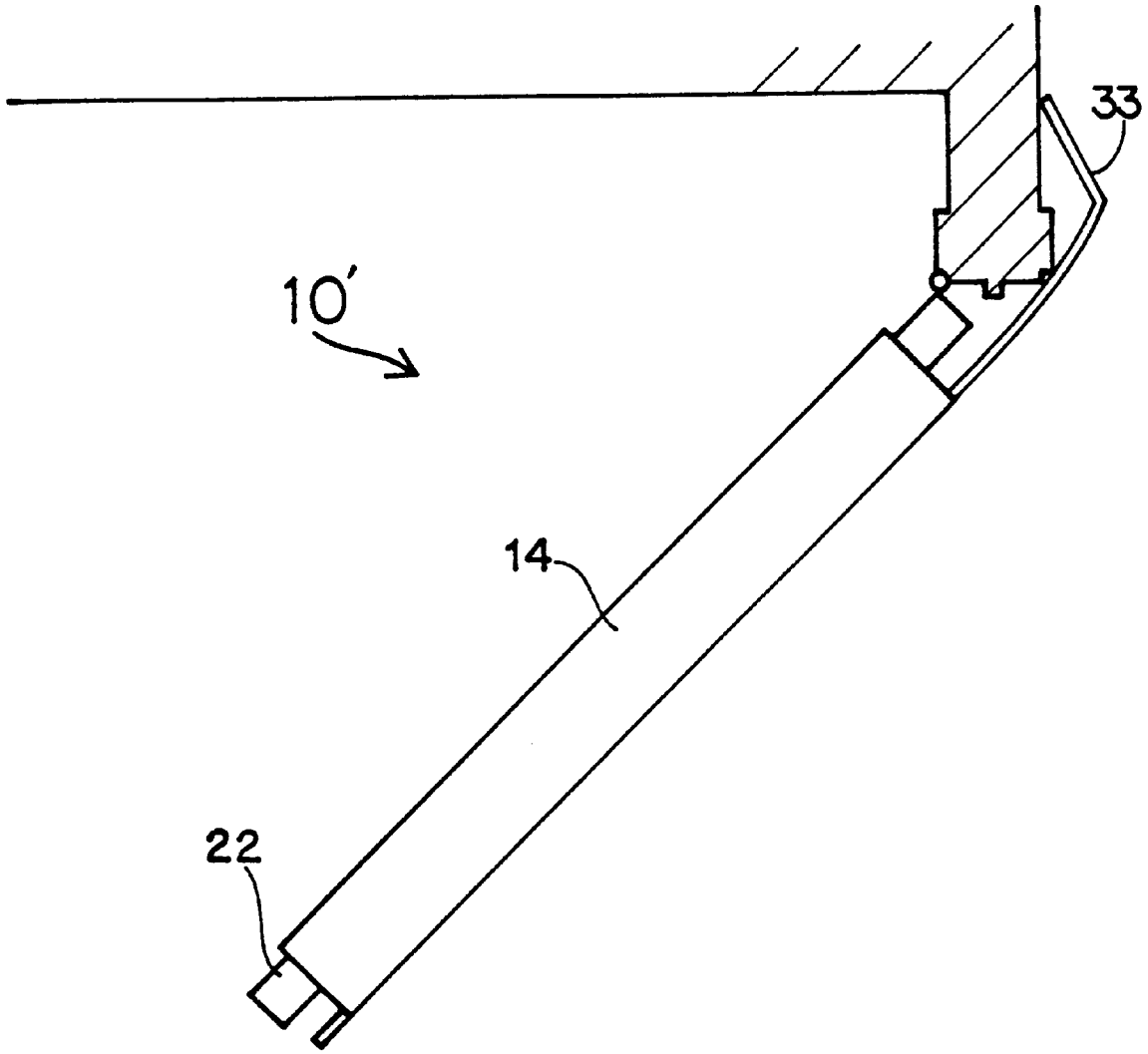
FIG. 5 is a top view of an alternative embodiment of the invention, including a bent trim portion but no trim hook.

Alternatively, as illustrated in FIG. 5, a trim hook may be replaced with a bent but not hooked trim portion 32. Such a trim portion may be bent/crimped or scored by lines running longitudinally along the trim portion to create a protective flap 33 which extends across the trim molding 38. Flap 33 may be bent at any variety of angles, but typically is bent at about 90 degrees to extend across and stay near the trim molding 38.

Figure 8:
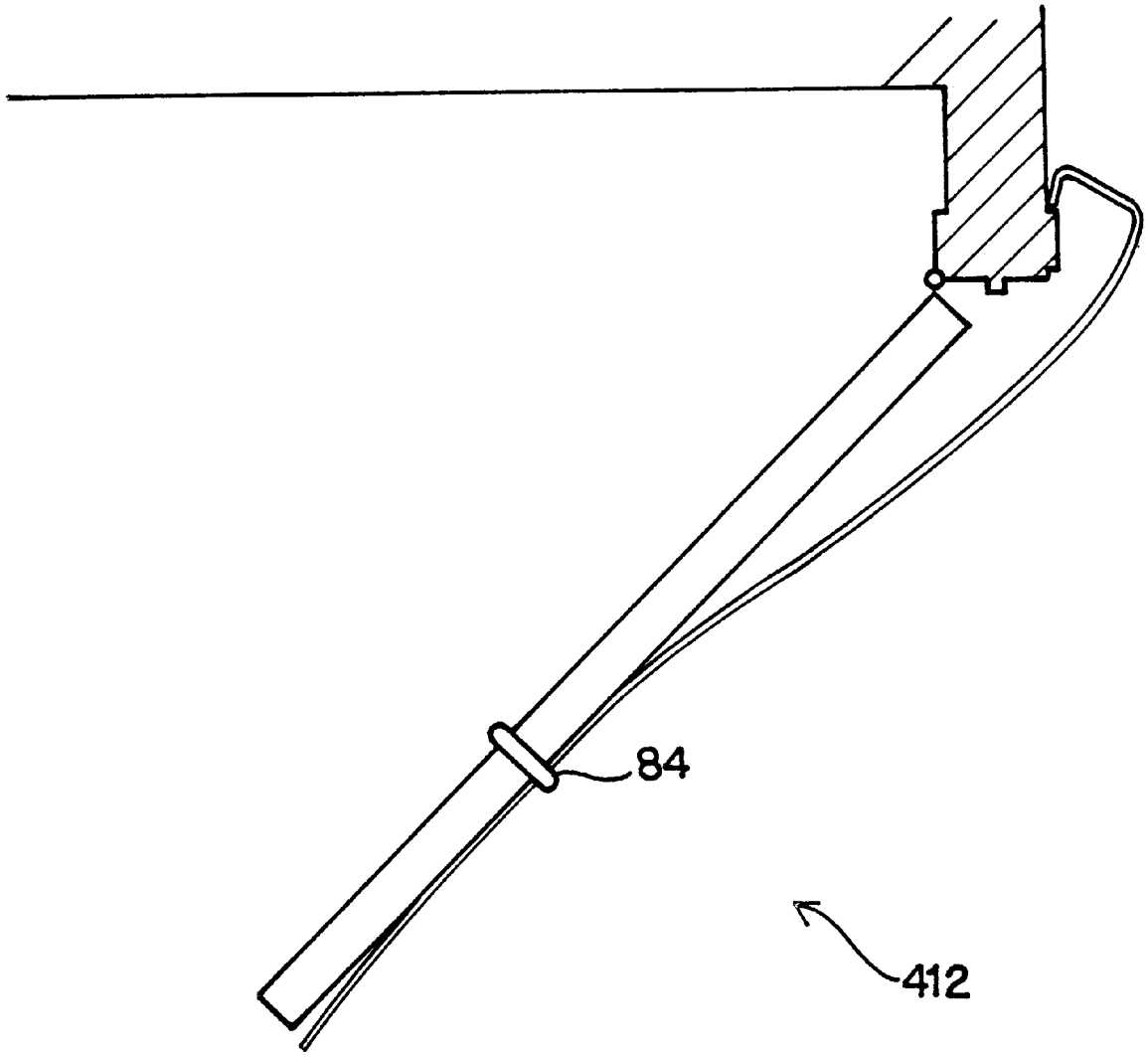
FIG. 8 is a top view of another embodiment of the invented shield system, without an outer door edge hook and without top or bottom edge hooks, but with a trim hook and a cord for securement of the shield.

A less-preferred embodiment is shown in FIG. 8, which is a shield 412 without top and bottom edge hooks, but with a trim hook 18 and a cord 84 for securement of the shield 412. The cord 84 preferably extends from top to bottom of the door, and may extend all the way around the door or may extend only around the back of the door by means of being attached to the top and bottom edges of the shield.

While several hook portions are preferred for securement on a door and doorway, the absence of some of the possible hooks lends the invented shield to be more easily rolled and stored. Therefore, a variety of designs with variously-placed hooks may be provided to match a particular user's taste and applications. For example, a rental moving truck company may supply several shields in each empty truck, and, because they may be stored flat in each truck conveniently, the truck company may choose shields with two or more hooks, but without cords or ties. Thus, the truck company would use and store flat the easily-hung and -handled shields without the risk of loss or tangling of cords. On the other hand, a craftsman who has a very full van of supplies and tools, and only occasionally requires the invented shield for his work, might prefer a shield with only one hook, preferably a top hook, because such a shield could be rolled, secured in a roll, and stored in a small space in his van.

Alternatively, hooks may be connected to the shield which are not integral, bent or crimped areas of the shield. Rigid tabs, wires, adhesives, magnets, or other fasteners may optionally be added in addition to or in place of the preferred hook portions.

Various materials may be used for the shield, including sturdy and preferably puncture-resistant or -proof plastics, fabrics, foam and cardboard. The preferred material is multi-layered sheet material, having an impact barrier 90 on the outside and a cushioning layer 92 on the inside. This way, the door and doorway are protected from impacts and also from rubbing of the shield on the door or doorway that might, without a cushion, cause scratching. The preferred material is a layer of polymeric plastic (preferably, polyethylene) film or sheeting of about 20–30 mil thickness for the barrier layer, backed by a closed-cell polyethylene foam of about ⅙"–¼" thickness as the cushioning layer. The two materials may be thermal welded or otherwise bonded to each other for a ratio of thicknesses of about 0.08–0.48. Alternatively, a single layer of a variety of protective materials could also be used.

Although this invention has been described above with reference to particular means, materials and embodiments, it is to be understood that the invention is not limited to these disclosed particulars, but extends instead to all equivalents within the scope of the following claims.

I claim:

1. A removable protective shield system comprising:

a doorway in a wall, the doorway comprising a hinge jamb and a trim molding having a front surface generally parallel to the wall and an edge surface generally perpendicular to the wall;

a door hung in the doorway, the door having opposing front and back surfaces, a top surface, a bottom surface, a hinge edge with a hinge surface, and a latch edge with a latch surface, a shield having a top edge, a bottom edge, a length between the top edge and bottom edge, a first side edge, a second side edge, and a width between the first side edge and second side edge, the shield covering at least a portion of the front surface of the door and further comprising:

a first hook extending from the top edge and extending over the door top surface so that the shield hangs on the door; and a trim portion near the first side edge extending across the front surface of the trim molding.

2. A shield system as in claim 1, wherein the trim portion has a longitudinal bend forming a flap that extends generally parallel to the front surface of the trim molding.

3. A shield system as in claim 1, wherein a gap exists between the door hinge edge and the doorway, wherein the shield extends across the gap and the shield system does not include any member that extends between the door and the doorway.

4. A shield system as in claim 1, wherein the doorway has a back trim molding and the shield system does not include any member that extends between the door and the doorway to contact the back trim molding.

5. A shield system as in claim 1 wherein the shield is multilayered and includes an outer polymeric puncture-proof barrier layer and a foam layer against the door.

6. A removable protective shield system comprising:

a doorway in a wall, the doorway comprising a hinge jamb and a trim molding having a front surface generally parallel to the wall and an edge surface generally perpendicular to the wall;

a door hung in the doorway, the door having opposing front and back surfaces, a top surface, a bottom surface, a hinge edge with a hinge surface, and a latch edge with a latch surface, a shield having a top edge, a bottom edge, a length between the top edge and bottom edge, a first side edge, a second side edge, and a width between the first side edge and second side edge, the shield further comprising:

a first hook extending from the top edge and extending over the door top surface so that the shield hangs on the door; and a trim portion near the first side edge having a second hook extending around the front surface of the trim molding and engaging the trim molding edge surface.

7. A shield system as in claim 6, wherein the second hook is formed from two longitudinal bends along substantially the entire first side edge of the shield.

8. A shield system as in claim 6, wherein the shield system does not include any member that extends between the door and the doorway.

9. A shield system as in claim 6, wherein the doorway has a back trim molding and the shield system does not include any member that extends between the door and the doorway to contact the back trim molding.

10. A shield system as in claim 6, wherein the first hook is an integral, bent extension of the shield along the entire top edge of the shield, wherein the first hook bends to engage the door top surface and the door back surface.

11. A shield system as in claim 6 wherein the shield is multilayered and includes an outer polymeric puncture-proof barrier layer and a foam layer against the door.

12. A shield for covering a door located in a doorway of a wall, wherein the door has opposing front and back surfaces, a top surface, a bottom surface, a hinge edge with a hinge surface, and a latch edge with a latch surface, and the doorway has a hinge jamb and a trim molding having a front surface generally parallel to the wall and an edge surface generally perpendicular to the wall, the shield comprises:

a front surface and a back surface, a top edge, a bottom edge, a length between the top edge and bottom edge, a first side edge at about 90 degrees to the top edge, a second side edge, and a width between the first side edge and second side edge, the shield further comprising:

a first J-shaped hook extending from the top edge toward the back surface of the shield, the hook comprising two bends of about 90 degrees extending substantially along the entire top edge for extending over the door top surface to hang the shield on the door; and a trim portion near the first side edge having a second J-shaped hook extending toward the back surface for extending around the front surface of the trim molding and engaging the edge surface of the trim molding.

13. A door and doorway shield system as set forth in claim 12, wherein the shield is multilayered and includes an outer polymeric puncture-proof barrier layer and a foam layer for facing toward the door.

14. A door and doorway shield system as set forth in claim 12, further comprising a cord extending between the top edge and the bottom edge of the shield for extending around a back surface of the door.

* * * * *